US005154459A

United States Patent [19]

Cochran

[11] Patent Number: 5,154,459

[45] Date of Patent: Oct. 13, 1992

[54] CAMPER SHELL LOCKING DEVICE

[76] Inventor: Mark W. Cochran, 6608 Mimosa Pl., Rancho Cucamonga, Calif. 91739

[21] Appl. No.: 822,811

[22] Filed: Jan. 21, 1992

[51] Int. Cl.[5] ..... E05C 19/18

[52] U.S. Cl. ..... 292/258; 292/288; 292/281; 292/205

[58] Field of Search ..... 70/2, 14, 19; 292/DIG. 79, DIG. 43, 258, 288, 284, 281, 297, 298, 205

[56] References Cited

U.S. PATENT DOCUMENTS

| | | | |
|---|---|---|---|
| 456,267 | 7/1891 | Davis | 292/298 |
| 945,558 | 1/1910 | Lent | 292/298 |
| 2,461,398 | 2/1949 | Sands | 292/297 |
| 2,536,941 | 1/1951 | Jones | 292/281 |
| 2,553,732 | 5/1951 | Young | 292/288 |
| 3,181,319 | 5/1965 | Hudon | 292/289 |
| 3,411,817 | 11/1968 | Craver | 292/298 |
| 3,475,929 | 11/1969 | Weingart | 70/14 |
| 3,572,796 | 3/1971 | Willner | 292/281 |
| 3,834,746 | 9/1974 | Hinden . | |
| 4,326,394 | 4/1982 | Stein | 70/14 |
| 4,389,862 | 6/1983 | Hastings . | |
| 4,488,417 | 12/1984 | Werner . | |
| 4,741,564 | 5/1988 | Alford | 292/205 |
| 4,819,461 | 4/1989 | Pearson . | |

FOREIGN PATENT DOCUMENTS

| | | | |
|---|---|---|---|
| 427819 | 5/1935 | United Kingdom | 292/205 |

*Primary Examiner*—Eric K. Nicholson
*Attorney, Agent, or Firm*—Henderson & Sturm

[57] ABSTRACT

A camper shell locking device (10) for captively engaging the door (102) of a camper shell relative to a truck tailgate (100); wherein, the device (10) comprises a main bracket member (20) having a sleeve element (21) which fits over the tailgate (100), and a backing plate member (24) which contacts the back of the camper door (102); and a closure panel member (30) pivotally connected to the sleeve element (21) and dimensioned to be engaged in a locked fashion against the front of the caper door (102).

1 Claim, 1 Drawing Sheet

CAMPER SHELL LOCKING DEVICE

TECHNICAL FIELD

This invention relates to the field of securing devices in general and in particular to a securing hasp for locking a camper shell to a truck body.

BACKGROUND ART

This invention was the subject matter of Document Disclosure Program Registration No. 282,792 which was filed in the United States Patent and Trademark Office on May 28, 1991.

As can be seen by reference to the following U.S. Pat. Nos. 4,819,461; 4,389,862; 4,488,417; and U.S. Pat. No. 3,834,746; the prior art is replete with myriad and diverse security devices for diverse items including at least one device for securing a camper shell to a truck.

While all of the aforementioned prior art constructions are more than adequate for the basic purpose and function for which they have been specifically designed, these devices are either neither intended to serve the purpose and function provided by the subject matter of the present invention, or are overly complex for the specific purpose of securing a camper shell to a truck body.

As most truck owners who have camping shells are all too painfully aware, one of the most pressing problems associated with this particular combination of structural elements is the ability or lack thereof of a secure means for locking the camping shell to the truck body.

As a consequence of the foregoing situation, there has existed a longstanding need among truck owners who also have camper shells for a simple, straightforward, device for locking the camper shell to the truck body in a safe and secure manner; and, the provision of such a construction is a stated objective of the present invention.

DISCLOSURE OF THE INVENTION

Briefly stated, the camper shell locking device that forms the basis of the present invention comprises a main bracket unit and a hinged cover unit; wherein, the main bracket unit has a lower portion provided with a hasp element and dimensioned to overlie and envelope the center portion of the truck tailgate; and, an upper portion that is dimensioned to overlie the central portion of the interior of the camper shell door.

In addition the hinged cover unit is operatively and pivotally connected to the lower portion of the main bracket unit and dimensioned to overlie the central portion of the exterior of the camper shell door.

As will be explained in greater detail further on in the specification, the hinged cover unit is further provided with a discrete aperture dimensioned to receive the hasp element of the main bracket unit; and, an enlarged recess that is dimensioned to receive the stem of the camper door handle; such that when the device is installed on the tailgate and a padlock engages the hasp element to captively engage the interior and exterior surfaces of the camper shell door it is physically impossible to open the door.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
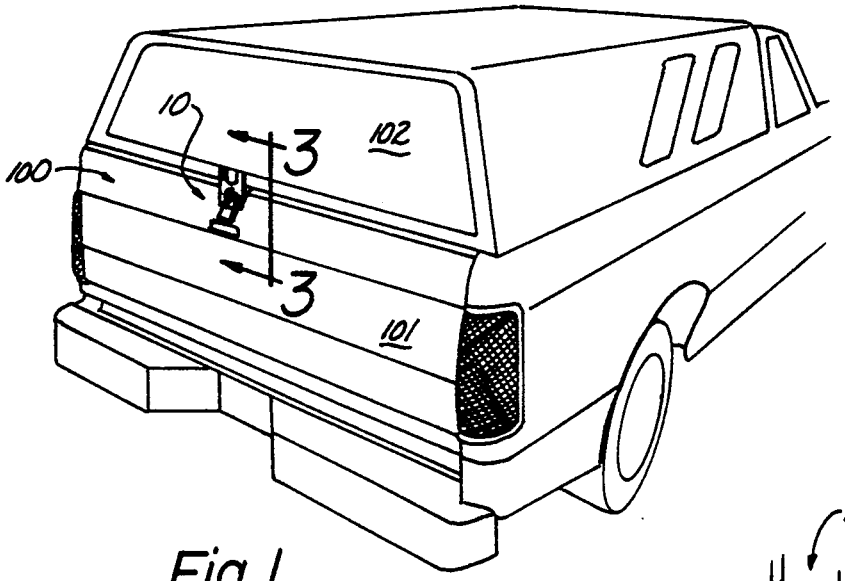
FIG. 1 is a perspective view of the camper shell locking device that forms the basis of the present invention employed in its intended manner.
Figure 2:
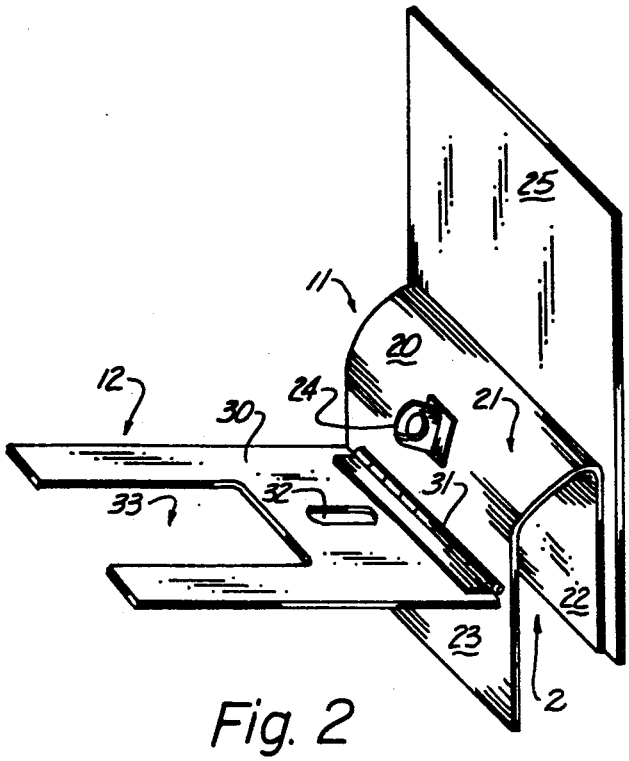
FIG. 2 is an isolated perspective view of the device.

As can be seen by reference to the drawings, and in particular to FIG. 1. the camper shell locking device that forms the basis of the present invention is designated generally by the reference numeral (10). Turning now to FIG. 2 it can be seen that the device (10) comprises in general: a main bracket unit (11); and, a hinged cover unit (12). These units will now be described in seriatim fashion.

Still referring to FIG. 2 it can be seen that the main bracket unit (11) comprises a generally h-shaped bracket member (20); wherein, the lower portion of the bracket member (20) comprises an inverted generally elongated U-shaped sleeve element (21) having a central opening (20') that is dimensioned to receive the central portion of the top of a truck tailgate (100). Furthermore the sleeve element (21) has an inner leg (22) that overlies a portion of the interior surface (101) of the tailgate; and, an outer leg (23) that overlies the exterior surface (102) of the tailgate; wherein, the upper portion of the outer leg (23) of the sleeve element (21) is further provided with a hasp member (24).

Figure 3:
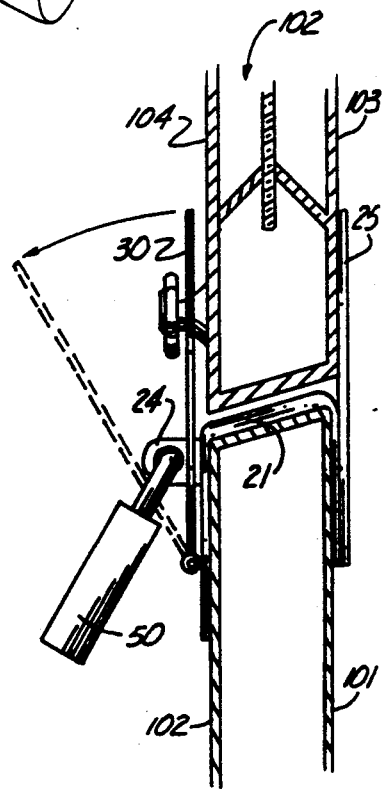
FIG. 3 is a side plan view of the device illustrating the captive engagement that occurs between the camper shell door and the tailgate of the truck.

As shown in FIGS. 2 and 3 the upper portion of the bracket member (20) comprises an elongated generally rectangular backing plate (25) which is operatively and rigidly attached to the rear face of inner leg (22) of the sleeve element (21); wherein, the plate (25) projects a substantial distance above the top of the sleeve element for reasons that will be explained shortly.

As can best be seen by reference to FIG. 2, the hinged cover unit (12) comprises a rigid contoured closure panel member (30) pivotally connected to the outer leg (23) of the bracket member (20) via a hinge element (31) disposed proximate the midpoint of the outer leg of the bracket member (20).

In addition the panel member (30) is further provided with a relatively discrete aperture (32) disposed proximate to, but spaced from, the hinge element (31); wherein, the aperture (32) is dimensioned to receive the hasp member (24) in a well recognized fashion.

Furthermore, the free end of the panel member is provided with an enlarged recess (33) which is dimensioned to receive at least a portion of the camper shell door handle (105).

As shown in FIG. 3, the sleeve element (21) captively engages the truck tailgate (100), and the upper portion of the backing plate (25) is disposed against the rear surface (103) of the camper door (102) when the door (102) is in its closed position. Then the closure panel member (30) is pivoted upwardly to contact the front surface (104) of the camper door (102) such that the hasp member (24) projects through the face of the closure panel member (30).

At this juncture a conventional lock (50) is engaged in the hasp member (24) such that the camper door (102) is captively engaged relative to the truck tailgate (100).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A camper shell locking device for captively engaging the door of a camper shell to the tailgate of a truck; wherein, the device comprises:

a main bracket member including an elongated sleeve element dimensioned to fit over the tailgate and having a hasp member provided on the front of the sleeve element; wherein, the main bracket member further comprises: an elongated backing panel member rigidly secured to the back of the sleeve element and projecting a substantial distance above the sleeve element; and, a closure panel member pivotally connected to the front of the sleeve element and provided with an aperture that is dimensioned to receive said hasp member; wherein, said closure panel member has a free end provided with a recess which is dimensioned to receive at least a portion of the handle of the camper shell door.

* * * * *